United States Patent [19]

Matsubara

[11] Patent Number: 4,632,048

[45] Date of Patent: Dec. 30, 1986

[54] METHOD OF CONTROLLING UPPER THREAD IN SEWING MACHINE

[75] Inventor: Toru Matsubara, Chofu, Japan

[73] Assignee: Tokyo Juki Industrial Co., Ltd., Tokyo, Japan

[21] Appl. No.: 692,330

[22] Filed: Jan. 17, 1985

Related U.S. Application Data

[63] Continuation of Ser. No. 411,803, Aug. 26, 1982, abandoned.

[51] Int. Cl.[4] ..... D05B 47/04; D05B 49/00

[52] U.S. Cl. ..... 112/262.1; 112/250; 112/255

[58] Field of Search ..... 112/97, 255, 262.1, 112/250

[56] References Cited

U.S. PATENT DOCUMENTS

| | | | |
|---|---|---|---|
| 1,312,799 | 8/1919 | Moffatt et al. | 112/255 |
| 2,652,017 | 9/1953 | Hohmann | 112/255 |
| 4,215,641 | 8/1980 | Dobrjanskyj et al. | 112/255 X |

*Primary Examiner*—Wm. Carter Reynolds

*Attorney, Agent, or Firm*—Parkhurst & Oliff

[57] ABSTRACT

The invention relates to a method of controlling an upper thread in a sewing machine. The sewing machine includes a needle holding the upper thread and vertically movable in association with a spindle, a loop taker holding a bobbin case carrier having a lower thread and rotatable in association with the spindle for forming a lock stitch in cooperation with the needle, and a thread take-up lever vertically movable in association with the spindle for loosening or taking up the upper thread. For a period of time from a moment at which a loop of the upper thread is released from a loop taker to a moment at which stitch tightening is completed, a tension required for stitch tightening is rendered to the upper thread. For a period of time from a moment before the loop of the upper thread is passed through a space between a notch and a lug of a rotation restraining finger to a moment after the loop of the upper thread is released from a loop controlling tail of the loop taker, a restraining force which does not permit the upper thread to be delivered from an upper thread supply source is rendered to the upper thread.

4 Claims, 7 Drawing Figures

METHOD OF CONTROLLING UPPER THREAD IN SEWING MACHINE

This is a continuation of application Ser. No. 411,803 filed Aug. 26, 1982, now abandoned.

BACKGROUND OF THE INVENTION

This invention relates to a sewing machine for forming lock stitches by an upper thread and a lower thread, and more particularly to a sewing machine capable of stitching up with the upper thread having a low tension.

The conventional lock stitch sewing machine has been constructed such that an upper thread is clamped by a clamping force of a predetermined value throughout the period of forming a lock stitch by a thread tension device in which two thread tension discs are pressed against each other by a spring and the upper thread is passed through a space between the thread tension discs, so that a tension can be rendered to the upper thread.

In the conventional sewing machine, unless a tension of about 120 g is rendered to the upper thread, a proper lock stitch cannot be formed in the case of stitching up at 4000 RPM by use of a cotton yarn number 50 for example.

Increased tension rendered to the upper thread necessitates the tension rendered to the lower thread to be increased because a knot formed by the upper and lower threads must be positioned in the center of thickness of a material at the time of stitch tightening. This increased tension rendered to the upper thread causes puckerings and material shrinkings to a sewn product, thus resulting in inferior quality of the sewn product.

In consequence, in the conventional sewing machine, when a low tension is rendered to the upper thread to form lock stitch seams, puckerings and material shrinkings are not caused to the sewn product. However, when seams are formed at high speed, lock stitches are not formed in the material, but, loops of the upper thread remain at the undersurface of the material, thus presenting the disadvantage that proper lock stitches cannot be formed.

In contrast thereto, when a high tension is rendered to the upper thread to form lock stitches, the lock stitches are formed in the material, however, puckerings and material shrinkings are caused to the sewn product, thus presenting the disadvantage that the market value of the sewn product is lowered.

SUMMARY OF THE INVENTION

The present invention has been developed to obviate the above-described disadvantages of the prior art and has as its object the provision of a sewing machine wherein, when the material is sewn from low speed to high speed by means of the sewing machine, lock stitches are properly formed and puckerings and material shrinkings are not caused to the material.

To achieve the above-described object, the present inventor performed the following experiments.

Changes in the tension rendered to the upper thread corresponding to positions of turning angles of a spindle of the sewing machine are measured during a rotation of the spindle, during which a lock stitch is formed. As the result, the inventor has found that, in the turning angles of the spindle, there are some portions where the tension rendered to the upper thread increases, as shown in FIG. 6A. Upon inspecting the conditions of the upper thread in the aforesaid portions, the inventor has found the following.

In FIG. 6A, a first point $P_1$ is disposed at about the spindle turning angle 120°, where a needle pierces a material, whereby a frictional resistance occurs between the upper thread and the material.

A second point $P_2$ is disposed at about the spindle turning angle 310°, where a loop TL of the upper thread is released from a loop seizing beak 24 of a loop taker 23 after the loop TL of the upper thread has been seized by the loop seizing beak 24 of the loop taker 23, enlarged by the loop taker and flanked a bobbin case carrier 25.

A third point $P_3$ is disposed at about the spindle turning angle 5°, where an upper thread T passes through a space formed between a notch 26 of the bobbin case carrier 25 and a lug 28 of a rotation restraining finger 27 after the upper thread T has been drawn up by a balance or thread take-up lever as shown in FIG. 5.

A fourth point $P_4$ is disposed at about the spindle turning angle 15°, where the loop TL of the upper thread is released from a loop controlling tail 29 of the loop taker 23 after the loop taker has been slightly rotated from a state shown in FIG. 5.

A fifth point $P_5$ is disposed at about the spindle turning angle 67°, where a knot of a lock stitch is formed in the material after the upper and lower threads have been engaged with each other.

When measurement is made how the value of the tension rendered to the upper thread at the aforesaid first through fifth points is varied due to the change in the rotational speed of the spindle of the sewing machine and so forth, it has been found that the tension acting on the upper thread at the first through fourth points increases with the increase in the rotational speed, whereas, the tension acting on the upper thread at the fifth point is hardly varied due to the change in the rotational speed.

In the conventional sewing machine which renders a tension of a predetermined value to the upper thread by the thread tension device, it is necessary to increase the value of tension of the lower thread in proportion to the upper thread. The increase in tension of the lower thread is necessary in order to make the value of tension rendered by the thread tension device proportional to the changes in tension in the first through fourth points which are variable due to the rotational speed of the spindle of the sewing machine. In addition, the increase in tension is required in order to prevent delivery of the upper thread from the side of the upper thread supply source. Thus, there has been presented the disadvantages of causing the aforesaid puckerings and material shrinkings to the material.

To technically obviate the disadvantages, the inventor has determined a process of rendering the clamping force to the upper thread from the upper thread supply source to the thread take up-lever such that the process is divided into two periods of time. The first period covers the points $P_1$ through $P_4$ as shown in FIG. 6 from the time the needle pierces the material to the time the loop of the upper thread TL is released from the loop controlling tail 29 of the loop taker 23. The second period covers the point $P_5$ where the upper and lower threads are engaged with each other to form a lock stitch. There has been provided a device capable of functioning such that, during a period convering at least $P_3$ and $P_4$ or during the first period as a whole as necessary, the upper thread is clamped by a force as high as possible so as not to allow the upper thread to be delivered from the side of the upper thread supply source, and, during the second period, the upper thread is clamped by a force as low as required for forming a knot of a lock stitch.

PREFERRED EMBODIMENTS OF THE INVENTION

Figure 1:
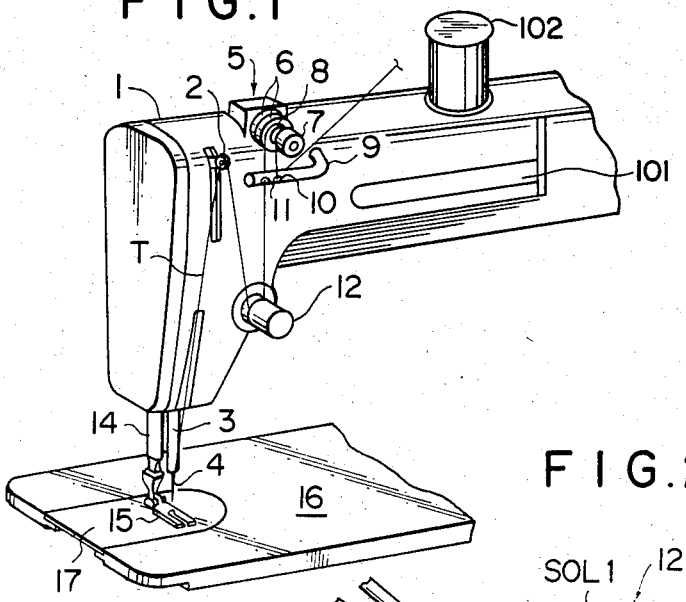
FIG. 1 is a fragmentary perspective view showing the front of a head of a sewing machine.

A frame 1 supports therein a spindle or main driving shaft 101 which is rotatable in association with a motive power member, not shown. The rotation of the spindle coordinates and drives the elements of the sewing machine described hereinafter. A balance or thread take-up lever 2 is vertically movable in association with a spindle through a well-known link mechanism. A needle bar 3 is vertically movably supported by the frame 1, adapted to be vertically movable through a well-known crank mechanism, and supports a needle 4 at the lower end thereof. A thread tension device, 5 has a spring 8 which presses a pair of thread tension discs 6 and 6 from one side through an adjusting finger grip 7, so that a clamping force generated between the pair of thread tension discs is adjusted. Rotation of the finger grip 7 varies the pressure of spring 8 on one of the discs 6 to adjustably vary the tension force on the thread between the disc 6,6. A thread guide 9 has a base portion affixed to the frame 1 and a forward end formed with thread holes 10 and 11. An electromagnet 12 has an attracting coil SOL 1 and a repulsing 2. The electromagnet 12 is provided at one end face thereof with an attraction plate 13 which is a magnetized armature.

A well-known presser bar 14 is vertically movably supported by the frame 1. The presser bar 14 is normally subjected to a downward resilient force and supports a presser metal 15 at the lower end thereof. Designated at 16 is a head and 17 a throat plate.

Figure 3:
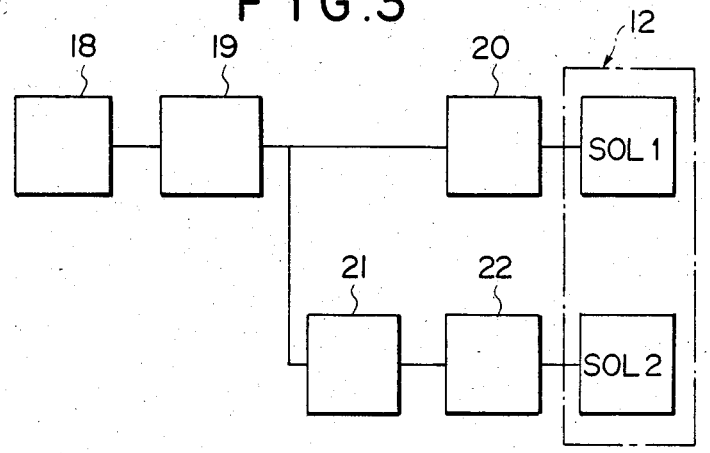
FIG. 3 is a block diagram of a circuit.

FIG. 3 is a circuit diagram for controlling an electromagnet 12, in which a detector 18 is provided for detecting a turning angle of the spindle to generate an electric signal. This detector, not shown, has, for example, a disc affixed to the spindle and a light emitting diode and a phototransistor opposed to each other, with the disc being interposed therebetween. As shown in FIGS. 6B and 6C, the disc is formed therein with a slit for allowing the phototransistor to receive the light from about 120° to 15° of the spindle turning angle to generate an output signal. A wave form shaping circuit 19 an output circuit 20 and the electromagnet 12 having the aforesaid attracting coil SOL 1 and repulsing coil SOL 2 are also provided in the circuit. A timer 21 is provided for generating an output signal for a short period of time after the output signal from the detector is interrupted. Designated at 22 is an output circuit.

The present invention has the above-described construction. Description will now be given of operation thereof.

Figure 2:
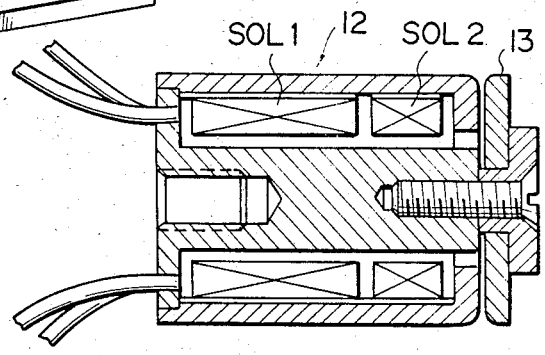
FIG. 2 is a sectional view showing an electromagnet.

As shown in FIG. 1, the upper thread T from the upper thread supply source 102 is passed through the thread hole 10 of the thread guide 9, and thereafter, racked across the two thread tension discs 6 and 6 of the thread tension device 5, turned back downwardly, and passed through the thread hole 11 of the thread guide 9. Further, the upper thread is led downwardly to the electromagnet 12, and passed through a space formed between the right end face of the electromagnet 12 and the attraction plate 13 as shown in FIG. 2. Thereafter, the thread t is turned back upwardly, passed through a thread hole of the thread take-up lever 2, and then, turned back downwardly. Further, the upper thread is passed through a thread hole of the needle 4, not shown.

Figure 6:
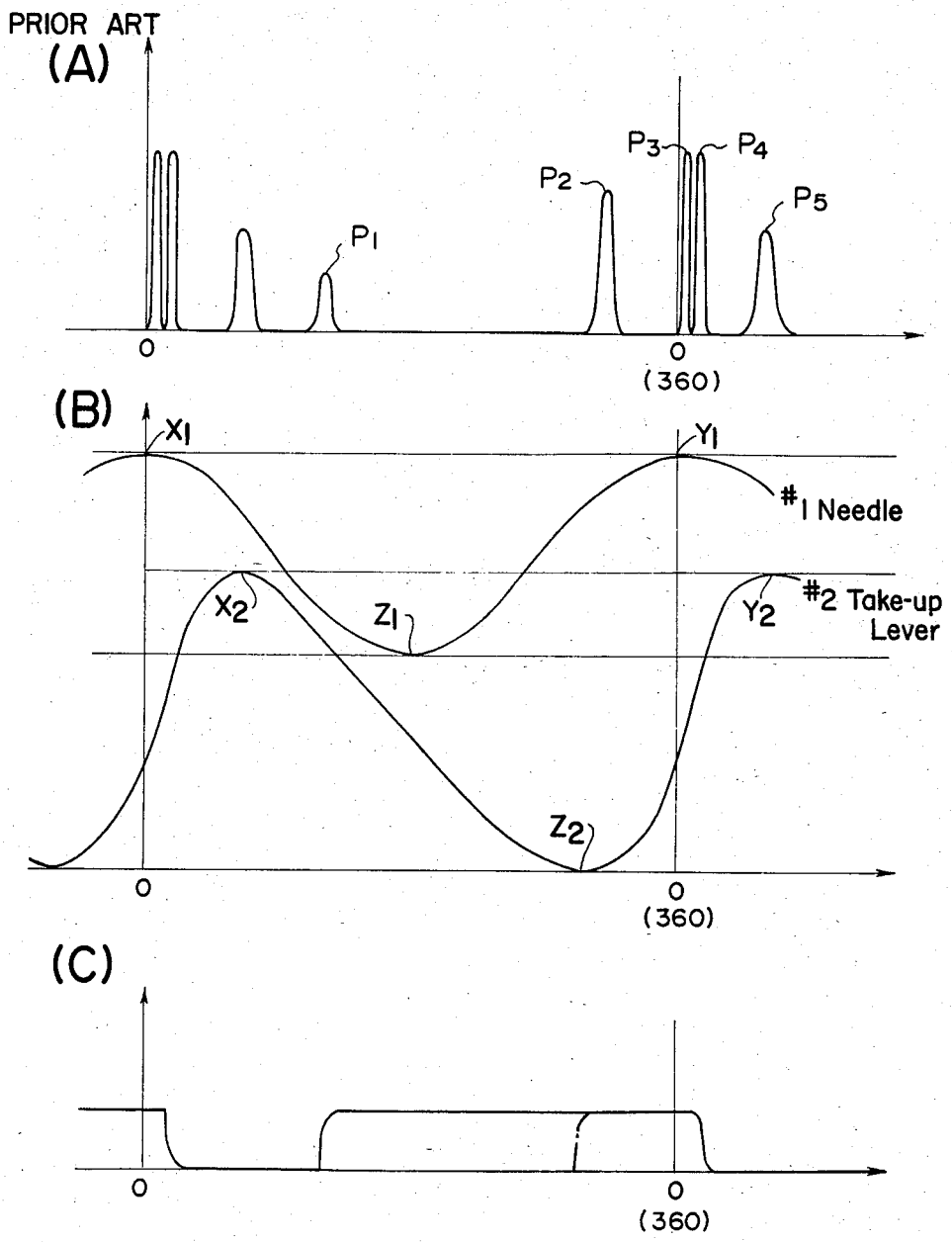
FIG. 6A is an explanatory view showing a motion diagram of the sewing threads and changes in tension acting on the upper thread versus spindle turning angle in prior art sewing machines.
FIG. 6B is an explanatory view showing motion of a thread take-up lever and a needle versus spindle turning angles in accordance with the present inventive method for controlling an upper thread.
FIG. 6C is an explanatory view showing periods of time in which a thread holding device or electromagnet 12 is activated versus spindle turning angle in accordance with the present inventive method for controlling an upper thread.

A cycle of operation is illustrated in FIG. 6 from a spindle turning angle of 0° to a spindle turning angle of 360°. As discussed above, FIG. 6A illustrates the known changes in tension acting on the upper thread for various spindle turning angles. The movement of the needle and thread take-up lever in accordance with the present invention are illustrated in FIGS. 6B and 6C. In particular, curve 1 illustrates the motion of the needle versus the spindle turning angle. Points X1 and Y1 illustrate the top dead point of the needle while point Z1 illustrates the bottom dead point of the needle. Curve 2 illustrates the motion of the thread take-up lever versus the spindle turning angle. Points X2 and Y2 illustrate the top dead points of the thread take-up lever and point Z2 illustrates the bottom dead point of the thread take-up lever. The activation of the thread holding device or electromagnet 12 is illustrated in FIG. 6C. Activation of the electromagnet 12 to the "ON" position provides a clamping force on the upper thread while the "OFF" position indicates that the electromagnet is de-energized such that no clamping force is provided.

Description will hereunder be given of a cycle, during which, the spindle makes one rotation to form a lock stitch. With reference to FIG. 6, the cycle starts from the point where the thread take-up lever is stationary at its top dead center.

The turning angle of the spindle at the time when the thread take-up lever 2 is in its top dead center is a position in which the spindle has been rotated through 67° from the top dead center of the needle. Since no output signal is emitted from the detector 18 at this position, the electromagnet 12 is "OFF". In FIG. 6(C), the strength of the output signal when the electromagnet is "OFF" is illustrated as zero.

When the spindle of the sewing machine begins to rotate from this condition, the thread take-up lever 2 descends to loosen a portion of the upper thread between the electromagnet 12 and the needle 4, and the needle 4 also descends.

When the spindle rotates through about the turning angle 120°, the detector 18 emits an output signal so as to excite the coil SOL 1 of the electromagnet 12 through the output circuit 20, whereby the attraction plate 13 shown in FIG. 2 is attracted to firmly clamp the upper thread passing therethrough. As illustrated in FIG. 6(C), the strength of the output signal of the electromagnet is at a maximum when the electromagnet is "ON". The needle 4 can pierce the material at about the spindle turning angle 120°. The thread is clamped during the first period of time which commences at the moment the needle pierces the material.

After the spindle is further rotated and the needle 4 reaches its bottom dead center, the needle slightly ascends. At this time, a loop TL of the upper thread is formed. This loop is seized by the loop seizing beak 24 of the loop taker 23. The thread take-up lever 2 further descends to loosen the upper thread, the and loop of the upper thread is progressively enlarged for flanking the bobbin case carrier 25. The loop becomes largest at about the spindle turning angle 300°, and the thread take-up lever 2 reaches its bottom dead center as well.

Figure 5:
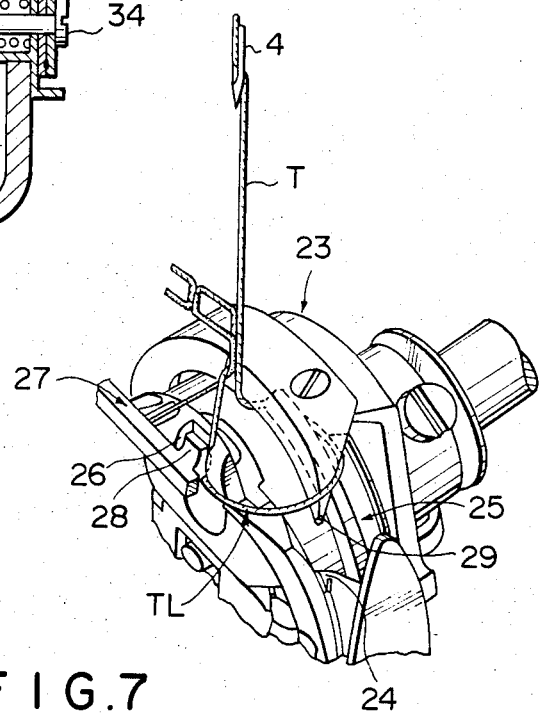
FIG. 5 is a perspective view showing a condition of the loop of upper thread immediately before the loop is released from a loop taker.

If the spindle further rotates, thread take-up lever 2 begins to ascend to take up the loop TL of the upper thread, which has flanked the bobbin case carrier 25, the loop becomes progressively smaller, and the needle 4 reaches its top dead center. As shown in FIG. 5, the upper thread is passed through a gap formed between the notch 26 of the bobbin case carrier 25 and the lug 28 of the rotation restraining finger 27 at about the spindle turning angle 5° as shown in FIG. 6. The upper thread is then seized by the loop controlling tail 29. Further, after being taken up by the thread take-up lever 2, the loop TL of the upper thread, which has been seized by the loop controlling tail 29, is released from the tail 29 at about the spindle turning angle 10° as shown in FIG. 6. The first period of time ends when the upper thread is released from the tail 29.

Even if a tension of a high value occurs in the upper thread when the loop TL of the upper thread is passed through the gap formed between the notch 26 and the lug 28 or when the loop TL is seized by the loop controlling tail 29, the upper thread is not delivered from the side of the upper thread supply source because the electromagnet 12 is excited during this period of time. The electromagnet provides a relatively high clamping force on the thread during the first time period.

When the loop TL of the upper thread reaches a position close to the spindle turning angle 15° after the loop has been released from the loop controlling tail 29, the output signal from the detector 18 is interrupted, electric current to the attracting coil SOL 1 is shut off, and at the same time, an output signal is emitted from the timer 21 for a short period of time to excite the repulsing coil SOL 2. As a result residual magnetism in the attracting coil SOL 1 is repulsed in a short period of time, so that the attracting coil SOL 1 can release the clamping of the upper thread in a short period of time.

If the spindle further rotates, then the loop TL of the upper thread, which has been released from the loop controlling tail 29, is taken up by the thread take-up lever 2. A length of the upper thread, which has been consumed for formation of one lock stitch is delivered through a space between the thread tension discs 6 and 6 of the thread tension device 5 stitch tightening is performed by a balance in tension between the upper thread and the lower thread, and a knot of a lock stitch is formed in the center of thickness of the material. The second period of time occurs during the time that the stitch is formed. During the second period, a relatively low clamping force is provided by the thread tension device 5 so that the knot can be formed.

In the embodiment described above, the first period of time commences at the point where the needle pierces the material and ends after the loop is released from the loop controlling tail. However, the first period may be shortened to begin at a moment before the loop is passed through a space between a notch and a lug of a rotation restraining finger. Such a shortened period is illustrated in FIG. 6C by the dot-dash line which indicates the energizing of the electromagnet from the "OFF" position to the "ON" position.

Figure 4:
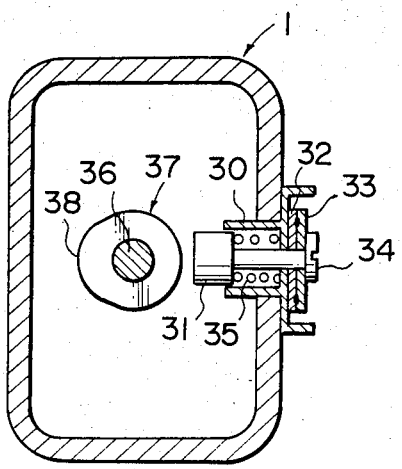
FIG. 4 is a sectional view showing another embodiment of a mechanical construction.

The electromagnet 12 shown in FIG. 1 may be replaced by a mechanical mechanism shown in FIG. 4.

More specifically, a cylinder 30 is affixed to the frame 1, and a shaft 31 is loosely coupled into the cylinder 30. A screw 34 having two thread tension discs 32 and 33 loosely coupled thereonto is threadably coupled into the shaft 31 from right side of the cyliner 30. In the cylinder 30, there is provided a strong spring 35, which urges the shaft 31 and the screw 34 to the left, so that a clamping force can be generated between the thread tension discs 32 and 33. A spindle 36 is rotatably supported in the frame 1. The spindle 36 has a cam 37 fixed to a portion of the spindle 36 opposed to the shaft 31. This cam 37 has a large diameter portion 38 corresponding to the spindle turning angle 120°–15° as shown in FIG. 6.

The electromagnet 12 shown in FIG. 1 is replaced by this thread tension mechanism with the above-described arrangement. The upper thread, which has been passed through the thread tension device 5 as shown in FIG. 1, is passed through a space between the thread tension discs 32 and 33 as shown in FIG. 4, and then, racked across the thread take-up lever 2 and the needle 4 as in FIG. 1.

If the spindle of the sewing machine is rotated from this state, then the large-diameter portion 38 of the cam 37 urges the shaft 31 to the right against the resiliency of the spring 35, at a position of the spindle turning angle 15°. The upper thread clamped by the thread tension discs 32 and 33 is released, and thereafter, stitch tightening is performed. When the spindle turning angle reaches a position close to 120°, the large-diameter portion 38 is rotated away, the upper thread is clamped by the strong spring 35, and this condition is maintained to a position close to the spindle turning angle 15°, whereby the upper thread is prevented from being delivered during the period of maintaining the aforesaid condition.

The thread tension device 5 versus the electromagnet 12 or the mechanism shown in FIG. 4 may be interchanged in position with respect to the course of the upper thread. Such an arrangement may be adopted so that the thread tension device 5 is disposed at the position of the electromagnet 12 in FIG. 1 and the electromagnet 12 or the mechanism shown in FIG. 4 is disposed at the position of the thread tension device 5.

There are further embodiments, in which the functions of the thread tension device 5 and the electromagnet 12 may be combined into a single device.

A first one of those embodiments is of such an arrangement that electric current of a high value is fed to the attracting coil SOL 1 of the electromagnet 12 shown in FIG. 2 during a rotation of the spindle through the turning angle 120°–15° as shown in FIG. 6 to strongly attract the attraction plate 13, whereby the upper thread is prevented from being delivered. However, electric current of a low value is fed to the attracting coil SOL 1 during a rotation of the spindle through the turning angle 15°–120°, so that a tension equal to that rendered to the upper thread by the thread tension device 5 shown in FIG. 1 can be rendered to the upper thread.

Figure 7:
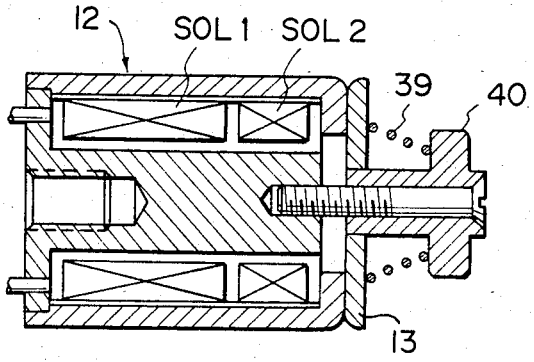
FIG. 7 is a sectional view showing a further embodiment.

In a second one of those embodiments, a portion of the electromagnet 12 is designed as shown in FIG. 7.

More specifically, a spring 39 acts on the attraction plate 13 from right side, and the spring 39 can be adjusted in strength by an adjusting screw 40. The electromagnet 12 functions in the same manner as in the embodiments shown in FIGS. 1 through 3. Namely, after the electromagnet has been turned "OFF" at about the spindle turning angle 15°, a tension equal to that rendered by the thread tension device 5 shown in FIG. 1 is rendered by the spring 39 so as to perform stitch tightening.

Further, the first period of time, during which the upper thread is strongly clamped by electrical or mechanical means may form a period of time during which the tension of the upper thread fluctuates to the maximum due to changes in rotational speed. That is a period of time from the moment immediately before the loop of the upper thread is passed through the space between the notch 26 of the bobbin case carrier 25 and the lug 28 of the rotation restraining finger 27 to the moment immediately after the loop of the upper thread is released from the loop controlling tail 29 of the loop taker 23.

As has been described hereinabove, for the first period of time during which the tension in the upper thread is varied due to changes in the rotational speed of the spindle of the sewing machine, a restraining force of a value not allowing the upper thread from being delivered from the upper thread supply source is rendered to the upper thread by the electrical or mechanical clamping means. For the second period of time during which the upper thread is released from the loop controlling tail and stitch tightening is completed, a tension required for stitch tightening is rendered to the upper thread by the lower clamping force of the thread tension device, thus enabling to offer the following advantages.

The tension acting on the upper thread during stitch tightening may be reduced in value to about $\frac{1}{2}$, $\frac{1}{3}$ or less, with the result that the tension of the lower thread may be decreased as well. In consequence, occurrences of puckerings and material shrinkings are reduced in number, thereby enabling to improve the quality of the sewn product.

In spite of changes in the rotational speed of the spindle of the sewing machine, proper seams may be formed at all times, thus enabling to eliminate regulation of changes in the rotational speed.

In spite of changes in the types of material and thread, proper seams may be formed, thus enabling a widening of the range of application to sewn materials.

What is claimed is:

1. A method of controlling an upper thread in a sewing machine comprising a needle holding said upper thread and being vertically movable in association with a spindle, a loop taker holding a bobbin case carrier having a lower thread and rotatable in association with said spindle for forming a lock stitch in a material in cooperation with said needle, and a thread take-up lever vertically movable in association with said spindle for selectively loosening and taking-up said upper thread, said method comprising the steps of:

rendering a restraining force to said upper thread by a thread holding device for selectively clamping said upper thread and preventing delivery of said upper thread to the thread take-up lever for a first period of time from a moment before the loop of the upper thread is passed through a space between a notch and a lug of a rotation restraining finger to a moment after the loop of the upper thread is released from a loop controlling tail of the loop taker, the restraining force preventing delivery of excess upper thread when a relatively high tension is applied to the loop of the upper thread as the loop is passed through the space and seized by the loop controlling tail;

rendering a tension to said upper thread by a thread tension device for stitch tightening for a second period of time from a moment after the upper thread is released from the loop controlling tail to a moment after stitch tightening is completed, the rendering of the tension by the thread tension device including disabling of said thread holding device and delivery of said upper thread under tension by said thread tension device; and delivering upper thread from said supply during said second period of time without bending said thread in said thread holding device in a direction generally parallel to an axis of said thread holding device, a direction of delivery of said upper thread through said thread holding device being in a direction generally normal to said axle.

2. The method of controlling an upper thread as set forth in claim 1, wherein the rendering of a restraining force during the first period of time by said thread holding device extends from a moment at which the needle pierces the material to the moment after the loop of the upper thread is released from the loop controlling tail of the loop taker.

3. The method of controlling an upper thread as set forth in claim 1, wherein the rendering of a tension to the upper thread by the thread tension device includes applying relative low tension to the upper thread sufficient to form a lock stitch.

4. The method of claim 1 wherein the step of rendering a restraining force to said upper thread by the thread holding device includes drawing one of two opposed discs toward the opposite disc along the axis of said thread holding device to clamp said thread therebetween, and the step of disabling said thread holding device includes moving at least one of said discs away from the opposite disc in a direction perpendicular to the direction of movement of the upper thread.

* * * * *